US007334715B2

(12) United States Patent
Oda et al.

(10) Patent No.: US 7,334,715 B2
(45) Date of Patent: Feb. 26, 2008

(54) ELECTRIC FASTENER DRIVER

(75) Inventors: Hiroyuki Oda, Hitachinaka (JP); Takashi Ueda, Hitachinaka (JP); Yoshihiro Nakano, Hitachinaka (JP); Hideyuki Tanimoto, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/588,369

(22) Filed: Oct. 27, 2006

(65) Prior Publication Data

US 2007/0095876 A1 May 3, 2007

(30) Foreign Application Priority Data

Oct. 28, 2005 (JP) ..... P2005-314035

(51) Int. Cl.
*B25C 5/15* (2006.01)

(52) U.S. Cl. ..... 227/2; 227/131; 173/178; 173/205

(58) Field of Classification Search ..... 227/2, 227/129, 131, 8, 120; 173/2, 117, 178, 176, 173/202, 205
See application file for complete search history.

(56) References Cited

U.S. PATENT DOCUMENTS 5,320,270 A * 6/1994 Crutcher ..... 227/131
5,511,715 A * 4/1996 Crutcher et al. ..... 227/131
6,607,111 B2 * 8/2003 Garvis et al. ..... 227/131
6,669,072 B2 * 12/2003 Burke et al. ..... 227/131
6,755,336 B2 * 6/2004 Harper et al. ..... 227/129
6,766,935 B2 * 7/2004 Pedicini et al. ..... 227/131
6,796,475 B2 * 9/2004 Adams ..... 227/2
6,971,567 B1 * 12/2005 Cannaliato et al. ..... 227/2
6,974,061 B2 * 12/2005 Adams et al. ..... 227/2
7,165,305 B2 * 1/2007 Kenney et al. ..... 29/434

FOREIGN PATENT DOCUMENTS

JP 06-278051 10/1994
JP 08-197455 8/1996

* cited by examiner

*Primary Examiner*—Scott A. Smith
(74) *Attorney, Agent, or Firm*—Antonelli, Terry, Stout & Kraus, LLP.

(57) ABSTRACT

A stationary annular abutting member 14E is provided with a first projecting section that operates as part of a ratchet mechanism. A rotational flange section is provided with a second projecting section that operates as part of the ratchet mechanism. The first projecting section projects in the direction from the ON position toward the OFF position of a plunger of a solenoid. The second projecting section projects in the direction from the OFF position toward the ON position of the plunger. When a driven rotor starts rotating and comes to a rotary position slightly short of the rotary position of about ¾ of a full turn in the ON state of the solenoid, the projecting end of the first projecting section and that of the second projecting section are located opposite to each other and the second projecting section rides on the first projecting section.

8 Claims, 7 Drawing Sheets

ELECTRIC FASTENER DRIVER

BACKGROUND OF THE INVENTION

The present invention relates to a fastener driver, and more particularly, to an electric fastener driver.

A compressed air type fastener driver such as a nail gun has been known. Compressed air generated by a compressor is used as a power source for the fastener driver. However, the use of a compressor is a prerequisite for compressed air type fastener drivers. Therefore, when operating a fastener driver while moving the driver from the ground floor to the first floor of a building, the compressor needs to be moved along with the fastener driver. In other words, such a combination lacks mobility. Additionally, a space needs to be provided for placing the compressor. However, sites of fastener driver operation do not always have a flat area for placing a compressor. In other words, sites of operation are limited for fastener driver that require the use of a compressor.

Electric fastener drivers adapted to drive a solenoid coil as main drive source, using electric power as motive power, are known that are less subject to limitations in terms of sites of operation and mobility. However, since the electric efficiency of solenoid coils is rather poor and between 5 and 20%, fastener drivers adapted to use a solenoid coil are inevitably heavy and bulky when the required drive power is large. More specifically, a fastener driver using a solenoid coil is about three times as heavy as a compressed air type fastener driver having a same output power. Then, to hold such a fastener driver by hand for a long time in order to drive nails has been difficult.

In an attempt to improve the electric efficiency of electric fastener drivers using a solenoid, a fastener driver using a flywheel has been proposed in laid open Japanese Patent Application Kokai Nos. H8-197455 and H6-278051. The flywheel is driven by electric power to drive a fastener exploiting the rotary kinetic energy accumulated in the flywheel.

For a fastener driver using a flywheel to drive a nail with reduced reaction force, the kinetic energy accumulated in the flywheel is necessarily be transmitted to the driver mechanism as motive power within the time to be spent for driving the nail (tens of several milliseconds). A fastener driver as described in Japanese Patent Application Kokai Nos. H8-197455 has a mechanism including a flywheel, a solenoid, a plurality of cams, a clutch and a ball.

The ball is accommodated in the groove of a ball inner pan and that of a ball outer pan and is nipped between the ball inner pan and the ball outer pan. The grooves have a varying depth and the ball moves in the groove relative to the ball inner pan and the ball outer pan as the ball outer pan is turned relative to the ball inner pan. When the ball is held in a shallow part of the grooves, the ball inner pan and the ball outer pan are relatively remote from each other, to render the clutch on. When, on the other hand, the ball is held in a deep part of the grooves, the ball inner pan and the ball outer pan are relatively close to each other, to render the clutch off.

The electric fastener driver adapted to drive a nail, exploiting the kinetic energy of such a flywheel shows an excellent electric efficiency between 50 and 70% and the nail driving energy can be boosted by raising the number of revolutions per unit time of the flywheel. Thus, such an electric fastener driver can be made to be only one and a half times heavier than a compressed air type fastener driver having the same output power.

However, in the known improved electric fastener driver, the clutch is turned on and off as the balls move in the grooves and the ball does no move uniformly in the grooves. In other words, to turn on and off the clutch precisely at a given rotary position of the ball outer pan relative to the ball inner pan has been difficult.

SUMMARY OF THE INVENTION

In view of the above-described problem in the conventional fastener driver, it is an object of the present invention to provide an electric fastener driver in which a clutch is turned on and off precisely at a given rotary position.

This and other object of the present invention will be attained by an electric fastener driver including a housing, a motor, a magazine, a flywheel, a driven rotor, a driver segment, a coil spring, a clutch mechanism including a solenoid, and a ratchet mechanism. The housing has a fastener driving position. The motor is disposed in the housing. The magazine is attached to the housing for supplying a fastener to the fastener driving position. The flywheel is rotatably supported to the housing and is driven by the motor. The driven rotor is rotatably supported to the housing. The driver segment is driven by the driven rotor. The coil spring is capable of transmitting rotation of the flywheel to the driven rotor. The clutch mechanism selectively couples the flywheel to the driven rotor through the coil spring. The solenoid has a plunger movable between ON position and OFF position. The ratchet mechanism has a forcible shut off arrangement that forcibly moves the plunger to the OFF position for forcibly shutting off power connection between the flywheel and the driven rotor when the driven rotor is rotated by a predetermined rotation angle after the flywheel and the driven rotor are connected to each other while the solenoid is turned ON.

BRIEF DESCRIPTION OF THE DRAWINGS

In the drawings;

FIGS. 6(*a*) through 6(*c*) are views for description of the ratchet mechanism including the first projecting section and a second projecting section of the ratchet mechanism, and in which FIG. 6(*a*) illustrates the state of two projecting parts when a plunger is ON and the clutch is also ON;

FIG. 6(*b*) illustrates the state of two projecting sections when the second projecting section starts riding on the first projecting section;

FIG. 6(*c*) illustrates the state of two projecting sections when the second projecting section fully rides on the first projecting section;

FIG. 7(*b*) is a side view illustrating the urging section of the fastener driver of FIG. 1.

DETAILED DESCRIPTION OF THE PREFERRED EMBODIMENTS

Figure 1:
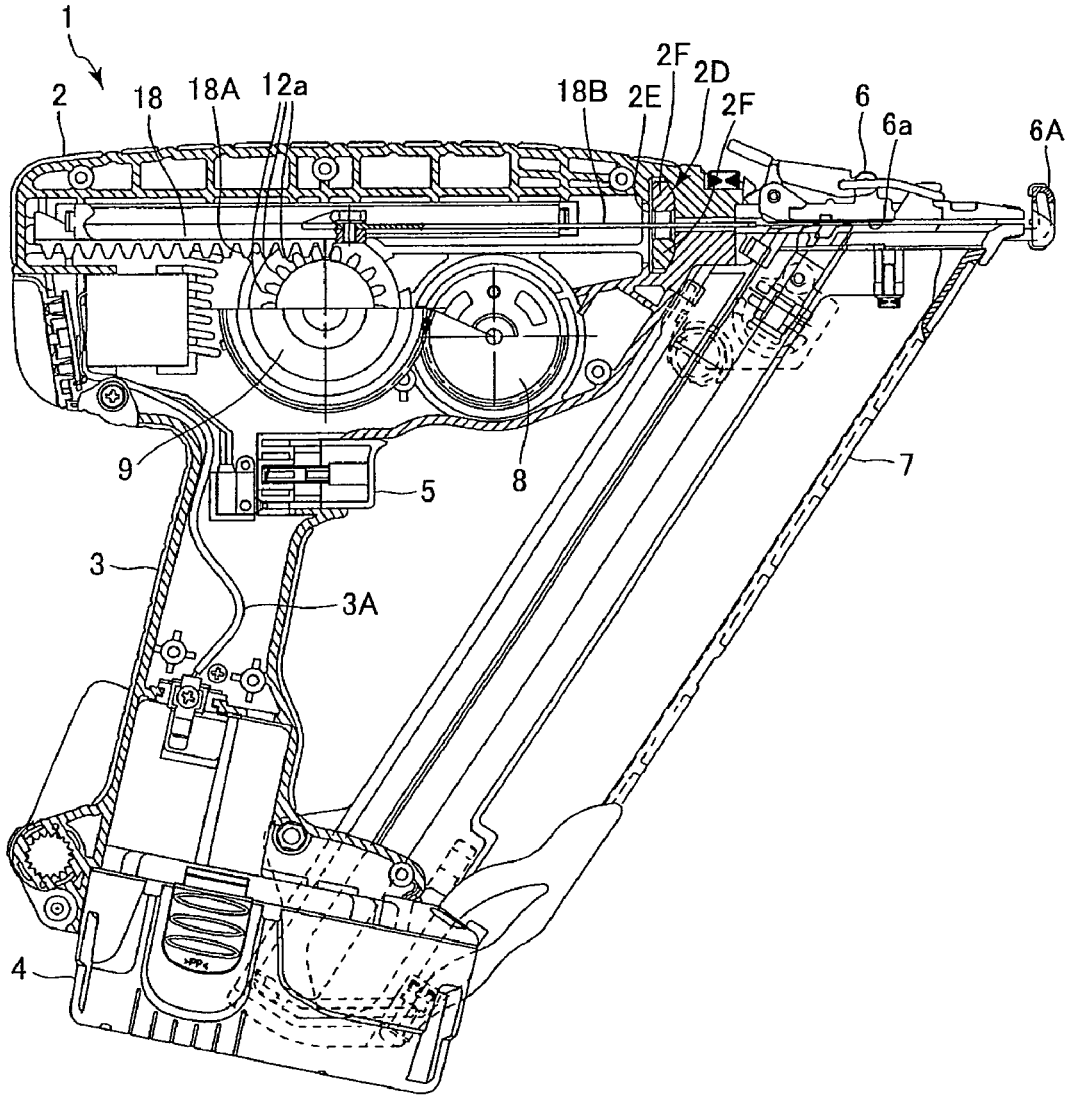
FIG. 1 is a schematic cross-sectional side view of a fastener driver according to an embodiment of the present invention.

A fastener driver according to one embodiment of the present invention will be described with reference to FIGS. 1 through 7. The fastener driver 1 schematically illustrated in FIG. 1 includes a housing 2 that is an outer shell, a handle 3, a battery 4, a nose 6 arranged at the front end i.e., the driving side of the housing 2, and a magazine 7.

A motor 8 and a driver segment 18 are arranged in the housing 2. The driver segment 18 is guided by a rail (not shown) in the housing 2 and is held movable between the front end side and the rear end side of the housing 2, that is, between the right end side and the left end side in FIG. 1. A blade 18B is provided at the front end of the driver segment 18 in such a way that the blade 18B extends to a position in a channel 6*a*, which will be described later, when the driver segment 18 moves to the front end side or the right side in FIG. 1, to the largest extent. A rack 18A is arranged as a part of the driver segment 18 and located at the side of the handle 3.

A damper section 2D is disposed in the housing 2 at an open end of the channel 6*a* where the channel 6*a* is exposed to the internal space of the housing 2. The damper section 2D includes a plate-shaped member 2E with which the driver segment 18 collides when driving a nail, and a damper 2F for absorbing the impact of the collision of the driver segment 18 and the plate-shaped member 2E. A through-hole is formed in the plate-shaped member 2E to allow the blade 18B to pass therethrough and to extend into the channel 6*a*.

The handle 3 extends from the left lower end surface of the housing 2 so as to be gripped by hand as shown in FIG. 1. A trigger 5 is arranged at a base end section of the handle 3 to control the driving operation of the driver segment 18. The battery 4 is positioned at a free end of the handle 3 located remotest from the housing 2. The battery 4 supplies electric power to the motor 8 by way of wiring 3A arranged in the handle 3.

The channel 6*a* is formed from a position located at the side of the housing 2 to the front end of the nose 6 so as to allow the blade 18B to extend therethrough. A push lever 6A is provided at the front end of the channel 6*a* in such a way that the fastener driver 1 can drive a nail only when the push lever 6A is brought into contact with an object of nail driving and is pushed back by the latter.

The magazine 7 extends from the nose 6 to a position near the battery 4. The magazine 7 contains a plurality of nails in the form of a nail bundle (not shown) and supplies a nail into the channel 6*a* at a time. As the driver segment 18 is driven to move toward the front end side, the nail held in the channel 6*a* of the nose 6 is driven by the blade 18B into the workpiece(not shown).

Figure 2:
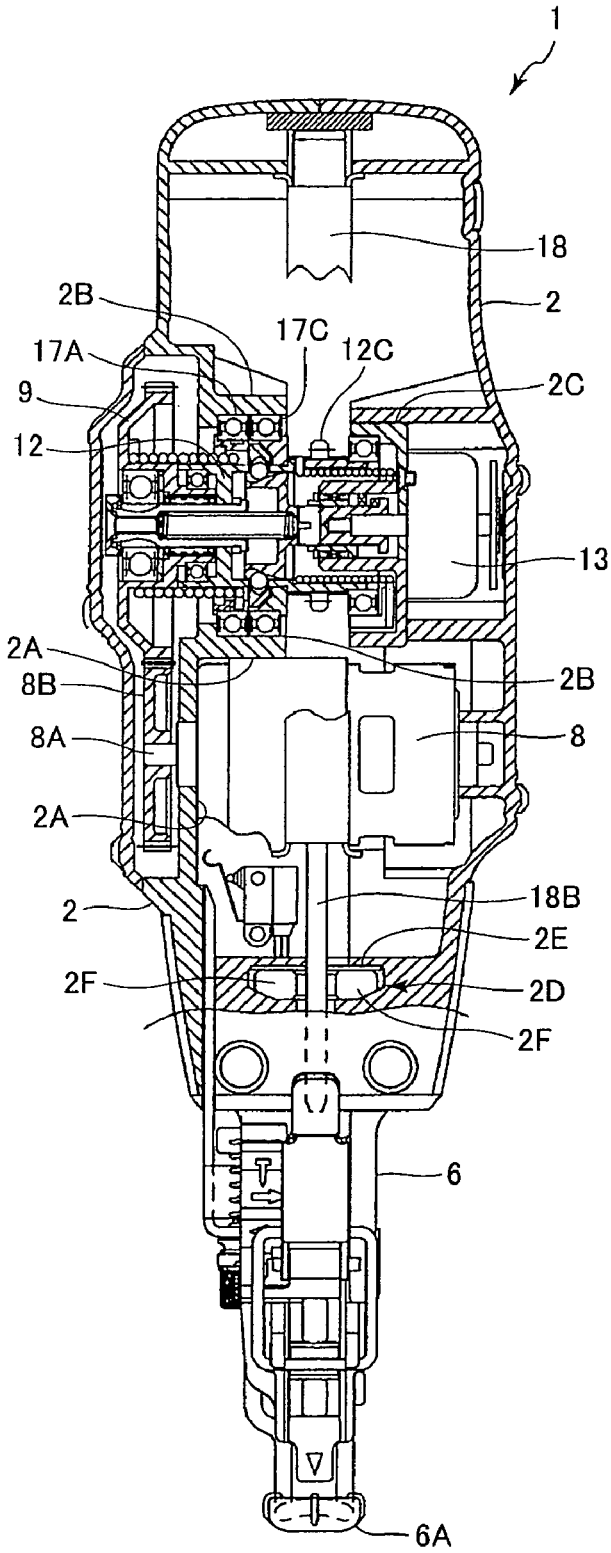
FIG. 2 is a schematic cross-sectional plan view of the fastener driver of FIG. 1.
Figure 3:
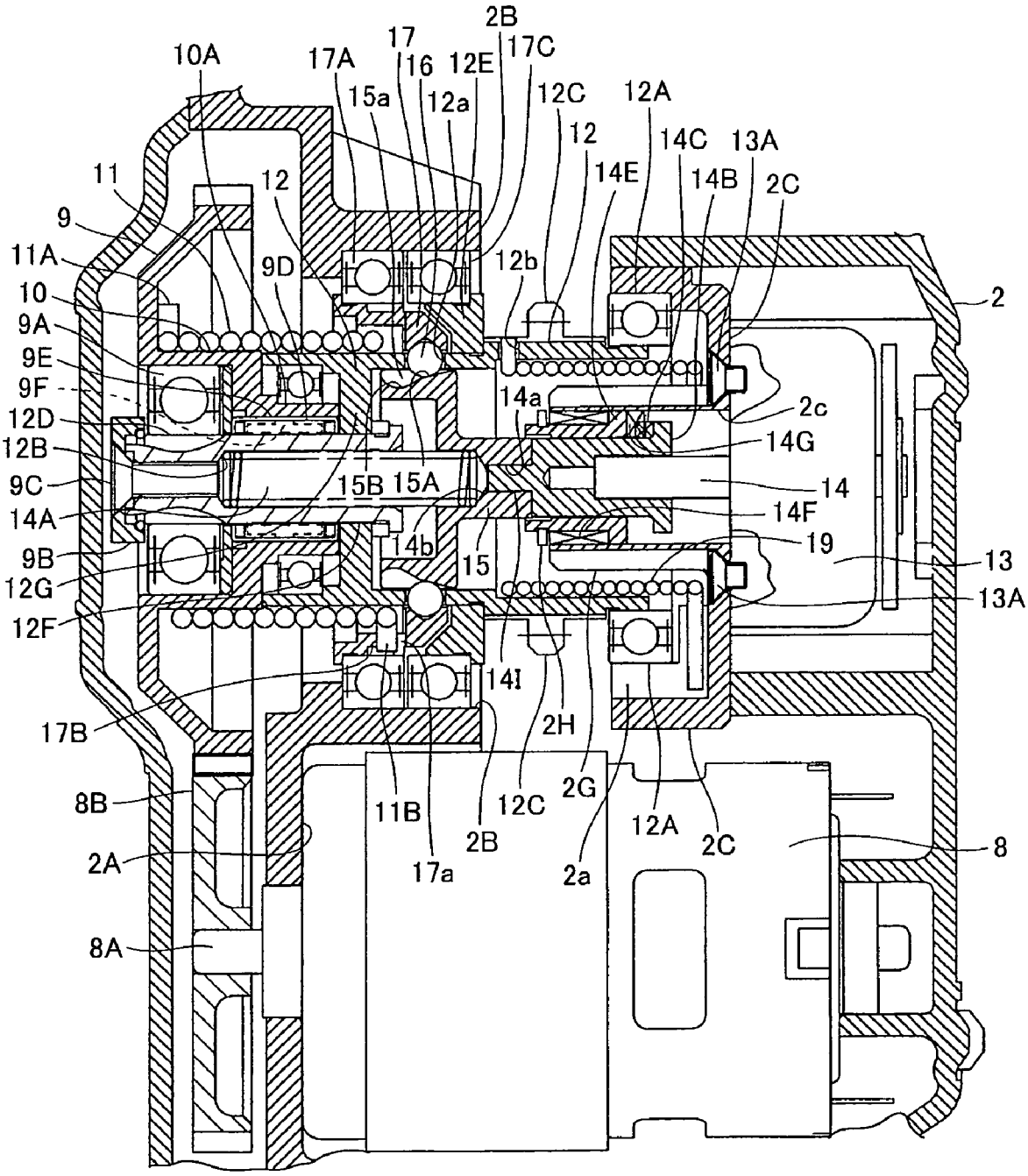
FIG. 3 is a schematic cross-sectional view of an essential portion of the fastener driver of FIG. 1 when a clutch mechanism provides a connection state to a power source.
Figure 4:
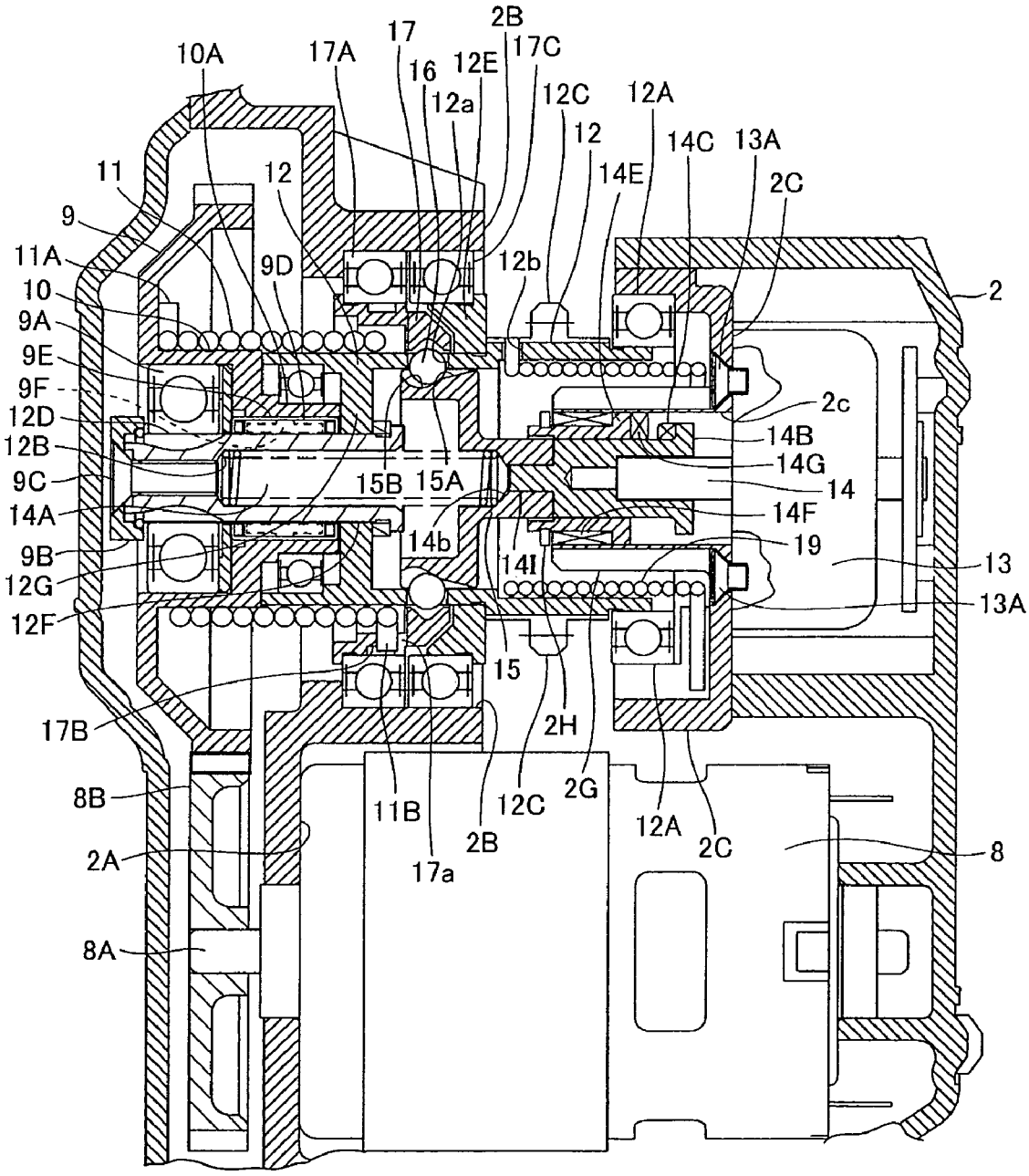
FIG. 4 is a schematic cross-sectional view of the essential portion of the fastener driver of FIG. 1 when the clutch mechanism provides a disconnection state from the power source.
Figure 5:
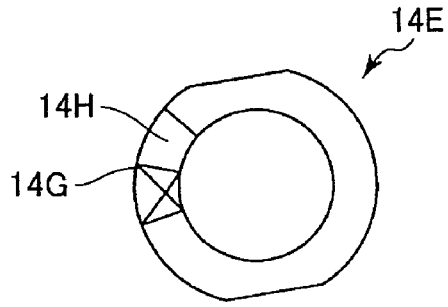
FIG. 5 is a schematic side view of a first projecting section of a ratchet mechanism in the fastener driver of FIG. 1.

Next, a mechanism for transmitting the power output of the motor 8 to the driver segment 18 in the housing 2 will be described below in detail. As shown in FIGS. 2 through 4, the housing 2 includes as part thereof a first wall 2A positioned at the front end side and a second wall 2B positioned at the rear end side relative to the first wall 2A and partly shared by the first wall. The housing 2 also includes a third wall 2C positioned substantially at a position same as that of the second wall 2B as viewed in the direction from the front end side to the rear end side of the housing 2 and rigidly held to the housing 2.

As shown in FIG. 3, the motor 8 is rigidly anchored to the first wall 2A and is oriented in such a way that the axial direction of the rotary shaft 8A is orthogonal to the moving direction of the driver segment 18. A gear 8B is coaxially rigidly fitted to the rotary shaft 8A, and the rotary shaft 8A and the gear 8B are adapted to rotate counterclockwise in FIG. 1. As shown in FIG. 3, a driven rotor 12 is rotatably supported by the second wall 2B by way of bearings 17A, 17C and an annular support member 12E which will be described later. An L-shaped groove 2*a* is formed in the third wall 2C to allow the inside and the outside of the driven rotor 12 to communicate with each other.

The driven rotor 12 has a substantially hollow cylindrical shape and the axis of the driven rotor 12 runs in parallel with the axis of the rotary shaft 8A of the motor 8. The driven rotor 12 is also rotatably supported by the third wall 2C by way of the bearing 12A. Thus, the driven rotor 12 is not movable in the axial direction and is stably rotatable even if abruptly subjected to external force, because the shaft 12 is supported by the housing 2 at two positions, i.e., at the position of the bearing 17C and position of the bearing 12A.

While a gap is seen between the bearing 12A that is shown below the driven rotor 12 and the third wall 2C in FIGS. 3 and 4, the gap is the groove 2*a* formed between the bearing 12A and the third wall 2C to receive an end of a driver segment return spring 19, which will be described later. Therefore, a cross-sectional view taken along a plane other than that of FIGS. 3 and 4 will show that the bearing 12A is rigidly held to the third wall 2C.

A pinion gear 12C is provided on an outer periphery of the driven rotor 12 at a position defined between the bearing 12A and the bearing 17A. The pinion gear 12C is meshedly engaged with the rack 18A (FIG. 1) so that the pinion gear 12C and the rack 18A form a driver segment feed mechanism.

A hole 12*b*, which is a through-hole for keeping the inside and the outside of the driven rotor 12 in communication with each other, is formed through the driven rotor 12 at a position located close to the pinion gear 12C and remote from the solenoid 13. The driver segment return spring 19 is positioned in the inside of the driven rotor 12 along the inner peripheral surface of the latter. One end of the driver segment return spring 19 is secured to the driven rotor 12 as the one end of the spring 19 is held in the hole 12*b*, while another end of the driver segment return spring 19 is secured to the third wall 2C as the other end of the spring 19 is held in the groove 2*a* formed in the third wall 2C.

The driver segment return spring 19 is wound about the axis of the driven rotor 12 in the inside of the driven rotor 12 when the driver segment 18 moves from the rear end side toward the front end side as will be described later. Therefore, after the driver segment 18 moves to the frontward stroke end for driving a nail, driver segment 18 is urged to move back toward the rear end side by a biasing force of the wound driver segment return spring 19 that tends to unwound itself. As a result, the return spring 19 prevents the driver segment 18 from remaining at the front end side after driving a nail.

As shown in FIG. 3, a generally annular clutch ring 17 is coaxially disposed around the driven rotor 12 with a slight gap interposed therebetween. Additionally, an annular support member 12E is also disposed around the driven rotor 12 at a position close to the solenoid 13, which will be described later and beside the clutch ring 17. The annular support member 12E is supported by the bearing 17C and rotatably supports the driven rotor 12.

As shown in FIGS. 3 and 4, the clutch ring 17 is substantially U-shaped in axial cross-section at a part thereof located opposite to the hole 12*a* of the driven rotor 12, which will be described in greater detail hereinafter. The clutch ring 17 has a part located close to the flywheel 9. The part serves as a spring holding section 17B, which is hollow, cylindrical and coaxial with the driven rotor 12. The inner diameter of the spring holding section 17B is larger than the outer diameter of the driven rotor 12. A hole 17*a* extends through a thickness of the spring holding section 17B. A hole 12*a* extends through a thickness of the driven rotor 12 at a position in confrontation with the clutch ring 17. A ball 16, which will be described later, can be entered into and movable relative to the hole 12*a*.

The solenoid 13 is positioned at one side of the driven rotor 12. As shown in FIGS. 3 and 4, the solenoid 13 is positioned in a region surrounded by the third wall 2C and the housing 2 and is fixed to the third wall 2C by means of screws 13A, 13A. A through-hole 2*c* is formed through the third wall 2C at a position in confrontation with the solenoid 13. A plunger 14 protrudes from the solenoid 13 and extends through the through-hole 2*c* toward the internal space of the driven rotor 12.

A third wall hollow cylindrical section 2G is rigidly secured to the third wall 2C so as to coaxially surround the plunger 14 extending through the through-hole 2*c*. A base end of the third wall hollow cylindrical section 2G is located close to the through-hole 2*c*. The third wall hollow cylindrical section 2G extends as far as the internal space of the driven rotor 12 and, as viewed in a radial direction of the driven rotor 12, the plunger 14 is located at the center, or the axis, of the driven rotor 12. That is, the third wall hollow cylindrical section 2G is located coaxially and radially outwardly relative to the plunger 14. Then, the driven rotor 12 is located coaxially and radially outwardly relative to the third wall hollow cylindrical section 2G.

The plunger 14 is adapted to move leftward in FIGS. 3 and 4 as the solenoid 13 is energized to become ON. On the other hand, the plunger 14 is located at right position in FIG. 4 when the solenoid 13 is not energized and held OFF. The driving operation of the plunger 14 is so regulated that the surface of the deepest part 15B of an urging section 15 is located opposite to the hole 12*a* in a deenergized state (at the de-energized position) of the plunger 14 when the plunger 14 is at the rightmost (contracted) position (FIG. 4). On the other hand, the inclined surface 15A of the urging section 15 is located opposite to the hole 12*a* in an energized state (at the energized position) of the plunger 14 when the plunger 14 is at the leftmost (extended) position. In the latter case, the inclined surface 15A, ball 16 and clutch ring 17 are in abutment with each other (FIG. 3).

A transmission switch section 14B, which is part of the ratchet mechanism, is provided at the front end of the plunger 14 to cover the latter. The transmission switch section 14B has a hollow cylindrical shape with one end closed and another end provided with a flange part. The inner diameter of the transmission switch section 14B is approximately equal to the outer diameter of the plunger 14. Thus, in the sate where the plunger 14 is positioned in the transmission switch section 14B, the transmission switch section 14B and the plunger 14 are movable together in the axial direction of the driven rotor 12. Further, the transmission switch section 14B is coaxially and rotatably supported by the plunger 14.

As a matter of convenience, the position of the plunger 14 when the solenoid 13 is energized to become ON will be referred to as ON position, whereas the position of the plunger 14 when the solenoid 13 is de-energized to become OFF will be referred to as OFF position hereinafter.

Figure 6A:
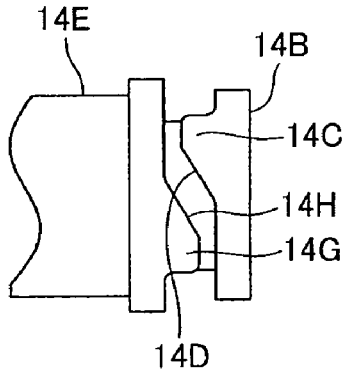
Figure 6B:
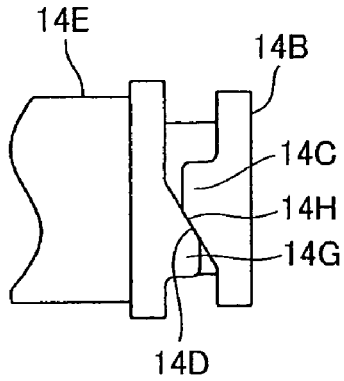
Figure 6C:
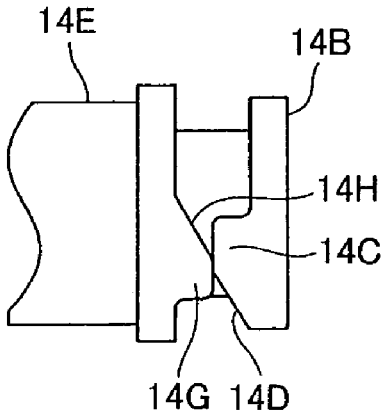

A second projecting section 14C that is part of the ratchet mechanism is provided at the flange part of the transmission switch section 14B. The second projecting section 14C projects in the direction from the OFF position toward the ON position of the plunger 14, or in the direction from the right side toward the left side in FIG. 3. As described later, the transmission switch section 14B is adapted to rotate together with the driven rotor 12 when the clutch mechanism is connected to the power source. As shown in FIG. 6, the second projecting section 14C has an inclined surface 14D at a distal end. The inclined surface 14D is inclined with respect to the rotating direction of the transmission switch section 14B. The second projecting section 14C can be positioned opposite to a first projecting section 14G described later.

An annular abutting member 14E is disposed around a part of the transmission switch section 14B at a position close to one end thereof as shown in FIGS. 3 and 4. The annular abutting member 14E is positioned between the transmission switch section 14B and the third wall hollow cylindrical section 2G. The annular abutting member 14E has an outer peripheral surface provided with a pair or antirotation projecting sections 14F projecting in a radial direction. A recess (not shown) is formed in the inner peripheral surface of the third wall hollow cylindrical section 2G. As the anti-rotation projecting sections 14F abut the recess, the annular abutting member 14E can no longer be rotatable relative to the third wall hollow cylindrical section 2G.

Additionally, the large diameter section (flange part) of the annular abutting member 14E abuts a small diameter section (not shown) of the inner peripheral surface of the third wall hollow cylindrical section 2G, and is rigidly secured in a given position by a retaining ring 2H so as to be immovable in the axial direction thereof relative to the third wall hollow cylindrical section 2G. The inner peripheral surface of the annular abutting member 14E abuts the outer peripheral surface of the transmission switch section 14B. Thus, the transmission switch section 14B is rotatable relative to the annular abutting member 14E.

The first projecting section 14G serving as a part of the ratchet mechanism is provided at one end (right side in FIG. 3) of the annular abutting member 14E. The first projecting section 14G projects in the direction from the ON position toward the OFF position of the plunger 14, or in the direction from the left side toward the right side in FIG. 3. The first projecting section 14G has an inclined surface 14H as shown in FIG. 6 at a position abuttable against the second projecting section 14C upon rotation. The projecting end of the first projecting section 14G and the projecting end of the second projecting section 14C are formed into flat surfaces as shown in FIG. 6.

In the OFF state of the solenoid 13 when the solenoid 13 is not energized, the second projecting section 14C is spaced away from the first projecting section 14G as shown in FIG. 4. As the solenoid 13 is energized to come into the ON state, the second projecting section 14C approaches the flange part of the annular abutting member 14E and the first projecting section 14G approaches and faces the flange part of the transmission switch section 14B, as shown in FIG. 3 and FIG. 6(*a*). Additionally, when the driven rotor 12 starts rotating and comes to a rotary position slightly short of the rotary position of about ¾ of a full turn in the ON state of the solenoid 13, the second projecting section inclined surface 14D rides on the first projecting section inclined surface 14H as shown in FIG. 6(*b*). Then, the projecting end of the first projecting section 14G and the projecting end of the second projecting section 14C face each other and the second projecting section 14C rides on the first projecting section 14G as shown in FIG. 6(*c*).

Thus, as a result, the transmission switch section 14B and the plunger 14 are forcibly retracted to the OFF position, so that the linkage between the flywheel 9 and the driven rotor 12 is forcibly cancelled. The rotary position of about ¾ of a full turn of the driven rotor 12 is the position where the driver segment 18 moves toward the front end side and drives a nail, and the front end of the driver segment 18 collides with the plate-shaped member 2E of the damper section 2D.

A linear projecting section 14I is provided at an end of the transmission switch section 14B. The linear projecting section 14I projects in the axial direction of the transmission switch section 14B, and extends in a radial direction of the transmission switch section 14B by a length equal to the diameter of the transmission switch section 14B, The linear projecting section 14I is engaged with a linear recessed section 14*a* formed at an end of an urging section 15 described below.

The urging section 15 is positioned at a position facing the end of the transmission switch section 14B. The urging section 15 has a substantially cylindrical reduced-diameter section at an end thereof and an increased-diameter section at the other end thereof that is connected to and coaxial with the reduced-diameter section. The linear recessed section 14*a* is formed in the reduced-diameter section and is recessed in the direction from the OFF position toward the ON position of the plunger 14. The liner recessed section 14*a* is engaged with the linear projecting section 14I of the transmission switch section 14B. With this arrangement, the rotary position of the transmission switch section 14B can be accurately defined, and integral rotation of the transmission switch section 14B and the urging section 15 can be performed. The increased-diameter section shows a hollow cylindrical profile, and an axial position recessed section 14*b* that is recessed in the direction toward the reduced-diameter section is formed at the increased-diameter section at a position connected to the reduced-diameter section and corresponding to the axis of the urging section 15.

Figure 7A:
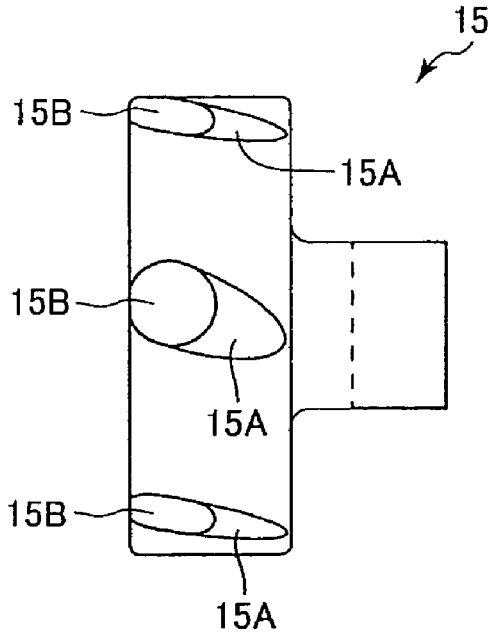
FIG. 7(*a*) is a front view illustrating an urging section of the fastener driver of FIG. 1.
Figure 7B:
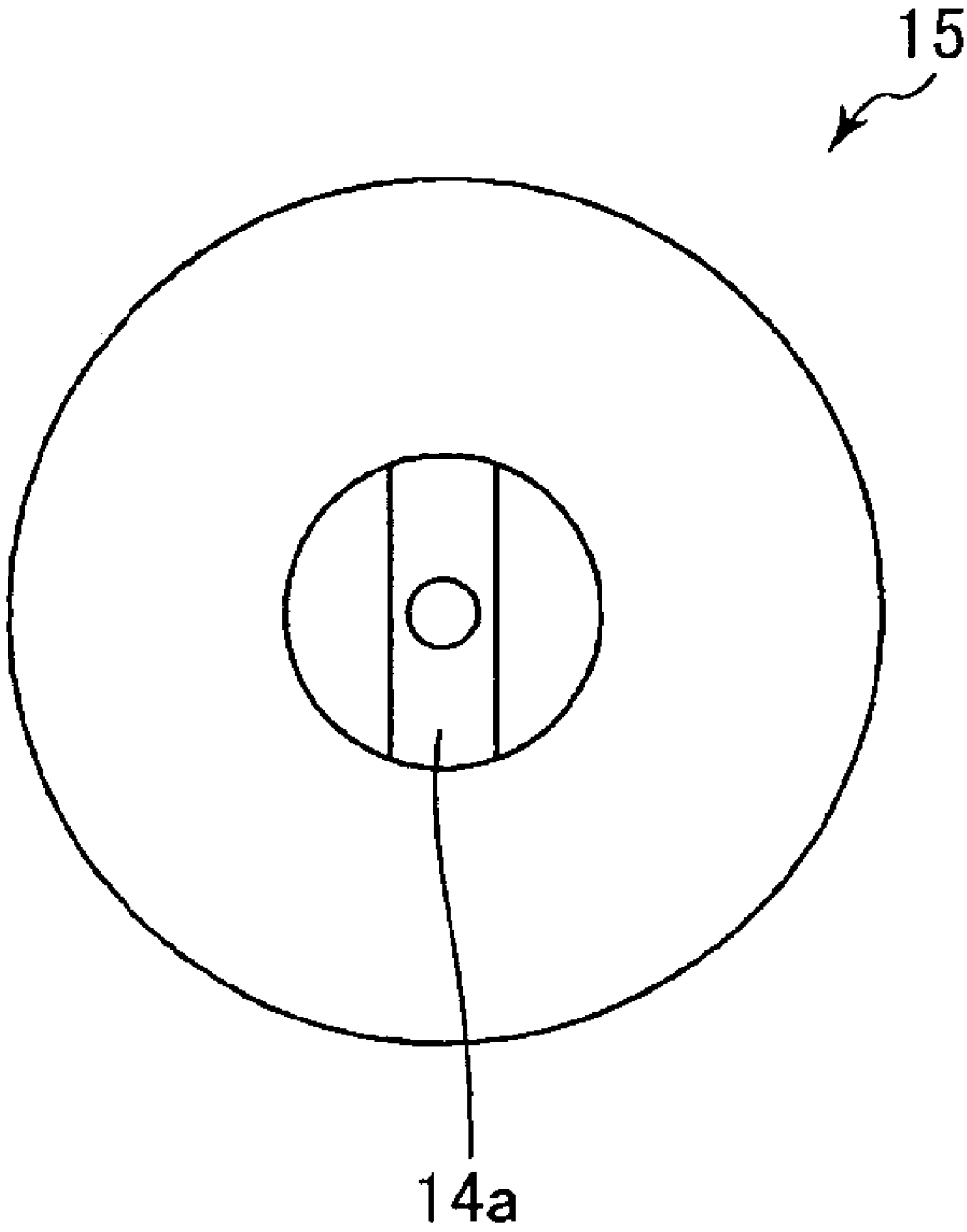

As shown in FIGS. 3, 4 and 7, the outer peripheral surface of the urging section 15 includes an inclined surface 15A and a deepest section 15B. A depth of the included surface 15A is gradually increased in the direction from the OFF position toward the ON position of the plunger 14 with showing a predetermined angle relative to the direction. The deepest section 15B is contiguous with the inclined surface 15A to provide the deepest depth. The deepest section shows a profile of part of a substantially spherical surface, so that a ball 16 be described later can be retained in the deepest section when the solenoid 13 is not energized in the OFF state. The urging section 15 has the largest outer diameter slightly smaller than the inner diameter of the driven rotor 12.

A gap 15*a* is defined among the inclined surface 15A, deepest section 15B and inner peripheral surface of the driven rotor 12 for defining an internal space. The deepest section 15B is so formed that the sum of the wall thickness near the hole 12*a* of the driven rotor 12 and the distance of the gap between the surface of the deepest section 15B and the inner peripheral surface of the driven rotor 12 that defines the internal space is substantially equal to the diameter of the ball 16. The clutch mechanism is constituted by the urging section 15, the ball 16, the solenoid 13 and the ratchet mechanism. The ball 16 is partly and constantly retained in the hole 12*a* so that the movement of the plunger 14 in its axial direction and the movement of the driven rotor 12 in its circumferential direction are restricted, whereas movement of the driven rotor 12 in its radial direction can be permitted.

To be more specific, the ball 16 is held in contact with the surface of the deepest section 15B in the condition where the plunger 14 is at the OFF position and contracted and the ball 16 would not project radially outwardly from the hole 12*a* beyond the outer peripheral surface of the driven rotor 12. In the condition where the plunger 14 is at the ON position and extended, the ball is held in contact with the inclined surface 15A and partly projects beyond the outer peripheral surface of the driven rotor 12 as shown in FIG. 3. As a result, the ball 16 is engaged with the substantially U-shaped section of the clutch ring 17.

The ball 16 may project out of the hole 12*a* due to the gravity depending on the inclination of the main body of the fastener driver 1. However, no urging force is exerted to the clutch ring 17 by the ball 16, since the ball 16 is not supported by the inclined surface 15A. As a result, the coil spring 11 (described later) will not be restrained by the clutch ring 17.

A solenoid return spring 14A that is a compression spring is disposed in the inside of the driven rotor 12. The solenoid return spring 14A has one end engaged with the axial position recessed section 14*b* of the urging section 15, and has another end held in contact with spring seat section 12B that defines the inner stepped surface of an internal sleeve member 12F described later disposed within the driven rotor 12. Thus, the solenoid return spring 14A constantly urges the urging section 15 and the transmission switch section 14B in the direction toward the solenoid 13.

The driven rotor 12 has in the inside thereof the internal sleeve member 12F. A support section 12G radially inwardly extends from the inner peripheral surface of the driven rotor 12 for supporting the internal sleeve member 12F. The internal sleeve member 12F is fixedly secured to and coaxially with the driven rotor 12 by the support section 12G at a position closer to the flywheel 9 than to the hole 12*a* of the driven rotor 12. The internal sleeve member 12F is rotatable together with the driven rotor 12.

The spring seat section 12B that is a stepped section is defined by part of the inner peripheral surface of the internal sleeve member 12F as shown in FIG. 3. The part of the internal sleeve member 12F has a support shaft 12D at a side remoter from the solenoid 13 than the spring seat section 12B. The flywheel 9 is rotatably disposed on the support shaft 12D by way of bearing 9A. A stop disc 9B is fitted to the free end of the support shaft 12D by means of a screw 9C to prevent the bearing 9A from coming off.

As described above, the driven rotor 12 is rotatably supported relative to the second wall 2B and the third wall 3C. Thus, the flywheel 9 is freely rotatable relative to the driven rotor 12 and to the housing 2, since the flywheel 9 is rotatably supported on the support shaft 12D of the internal sleeve member 12F, which is part of the driven rotor 12, by way of the bearing 9A.

A teeth section is arranged on the outer periphery of the flywheel 9 and is meshedly engaged with the gear 8B of the motor 8. Thus, as the gear 8B is driven to rotate, the flywheel 9 rotates clockwise in FIG. 1. The flywheel 9 has a driving rotary shaft 10 provided coaxially therewith and with the driven rotor 12. One end portion of the driving rotary shaft 10 is integrally connected to the wheel section of the flywheel 9, and has an outer diameter greater than a part of the outer diameter of the driven rotor 12, the part surrounding the internal sleeve member 12F. The driving rotary shaft 10 has another end portion where reduced diameter portion 10A is provided. The reduced diameter portion has a substantially cylindrical profile and has an outer diameter smaller than that of the driving rotary shaft 10.

A one way clutch 9D having a substantially cylindrical outer profile is disposed between the inner peripheral surface of the reduced diameter section 10A and the outer peripheral surface of the internal sleeve member 12F. The one-way clutch 9D is disposed coaxially with both the reduced diameter section 10A and the internal sleeve member 12F. The one-way clutch 9D is force-fitted with the inner peripheral surface of the reduced diameter section 10A, so that the one-way clutch 9D is unrotatable relative to the reduced diameter section 10A. Thus, the one way clutch 9D surrounds the internal sleeve member 12F, and the reduced diameter section 10A surrounds the one way clutch 9D.

The one way clutch 9D includes a casing 9E having a substantially hollow cylindrical profile, a plurality of cylindrical members 9F arranged in the axial direction of the casing 9E and a plurality of springs (not shown). The cylindrical members 9F are engaged with a groove-shaped recessed section (not shown) formed on the inner peripheral surface of the casing 9E. Each peripheral surface of each cylindrical member 9F project partly from the inner peripheral surface of the casing 9E. The springs (not shown) are arranged in the groove-shaped recessed section and urge the respective cylindrical members 9F to project from the inner peripheral surface of the casing 9E in a slanting direction relative to a radial direction of the cylindrical members 9F.

When the internal sleeve member 12F is urged to be rotated relative to the reduced diameter section 10A in the direction of rotation (clockwise) of the reduced diameter section 10A, the cylindrical members 9F move in the direction to project from the inner peripheral surface of the casing 9E to thus intrude between the cylindrical members 9F and the reduced diameter section 10A. As a result, the driven rotor 12 and the internal sleeve member 12F are brought into linkage to the flywheel 9 and the reduced diameter section 10A. Thus, the driven rotor 12 becomes unrotable relative to the flywheel 9.

On the other hand, when the internal sleeve member 12F is urged to be rotated relative to the reduced diameter section 10A in the opposite direction of rotation (counterclockwise) of the reduced diameter section 10A, the cylindrical members 9F are urged to be moved in the direction to be retained into the groove (not shown). Thus, the intruding condition of the cylindrical members 9F relative to the reduced diameter section 10A is cancelled. Then, as a result, the one way clutch 9D rotatably supports the driven rotor 12 relative to the flywheel 9.

The rotary speed of the driven rotor 12 may become relatively faster than the rotary speed of the flywheel 9 at a timing when the driven rotor 12 is linked to the flywheel 9 by the coil spring 11 of the clutch mechanism. However, the one-way clutch 9D can avoid the occurrence of the difference of rotary speed. Thus, unwinding of the coil spring 11 against the driven rotor 12 can be prevented. In other words, insufficient power transmission to the driven rotor 12 can be eliminated.

The coil spring 11 is coaxially wound over the driving rotary shaft 10. The coil spring 11 has one end 11A fixed to the driving rotary shaft 10. That is, the driving rotary shaft 10 has a projecting section (not shown), and the end 11A is hooked to the projecting section. The coil spring 11 has another end 11B rigidly anchored to the clutch ring 17. That is, the other end 11B is inserted into the hole 17*a* that is the through-hole formed through the spring holding section 17B of the clutch ring 17.

Since one end 11A of the coil spring 11 is secured to the driving rotary shaft 10, the power transmission and power transmission shut-off between the coil spring 11 and the driven rotor 12 can be performed. Further, the inertial force of the rotary motion of the coil spring 11 that rotates together with the flywheel 9 can be utilized as energy for driving a nail.

The coil spring 11 is formed by winding a steel wire into a cylindrical form. More specifically, as shown in FIGS. 3 and 4, the coil spring 11 is formed by densely arranging turns of the steel wire. The steel wire that is wound to form the coil spring 11 is turned counterclockwise from the end 11A toward the other end 11B. Thus, the spiral direction of the coil spring 11 is opposite to the direction of rotation of the flywheel 9.

The inner diameter of the coil spring 11 is substantially equal to or slightly smaller than the outer diameter 10 of the driving rotary shaft 10 when the spring 11 is at its free state. Further, the outer diameter of the driven rotor 12 is smaller than the outer diameter of the driving rotary shaft 10. Therefore, when the solenoid 13 is not energized, the inner diameter of the coil spring 11 is larger than the outer diameter of the driven rotor 12 and a gap is provided between the coil spring 11 and the driven rotor 12 to make the coil spring 11 loose. Thus, the coil spring 11 is not linked to the driven rotor 12.

As the solenoid 13 is energized while the coil spring 11 is connected to the flywheel 9 and rotating together, the ball 16 comes to contact the clutch ring 17. Thus, the diameter of the coil spring 11 is reduced so as to link the flywheel 9 and the driven rotor 12 by way of the coil spring 11, because the rotary speed of the flywheel 9 is greater than that of the driven rotor 12.

When the clutch mechanism is at the power transmission shut-off state, and hence the driver segment 18 is not driven, the inner diameter of the coil spring 11 is larger than the outer diameter of the driven rotor 12. Therefore, the driven rotor 12 is not driven to rotate if the motor 8 is operated in this condition. Thus, the driver segment 18 can be highly accurately controlled. Additionally, frictional wearing and the heat generation due to frictional contact between the coil spring 11 and the driven rotor 12 can be suppressed.

Next, nail driving operation with the fastener driver 1 will be described. Firstly, the operator pulls the trigger 5 and, at the same time, pushes the push lever 6A against the workpiece, or pushes the push lever 6A against the workpiece and subsequently pulls the trigger 5. Then, power is supplied from the battery 4 to the motor 8 and the motor 8 starts rotating the flywheel 9 engaged with the motor, the driving rotary shaft 10 and the coil spring 11.

As the motor 8 starts driving, the angular speed of the flywheel 9 increases to accumulate rotational energy. At this time, the ball 16 is not projecting from the hole 12*a* and hence does not contact the clutch ring 17. Therefore, as shown in FIG. 4, the coil spring 11 is not linked to the driven rotor 12 and hence the driven rotor 12 does not rotate. Thus, in this condition, no friction occurs between the coil spring 11 and the driven rotor 12.

As a predetermined time passes after the motor 8 starts rotating and the flywheel 9 accumulates energy sufficient for driving the driver segment 18 (necessary for driving a nail or the like), the solenoid 13 is energized to become ON and the plunger 14 extends against the biasing force of the solenoid return spring 14A. At this time, the surface that contacts the urging section 15 of the ball 16 is switched from the surface of the deepest section 15B to the inclined surface 15A. Then, as the plunger 14 extends, the ball 16 is moved outwardly in a radial direction of the driven rotor 12 by the inclined surface 15A and projects from the surface of the driven rotor 12.

As the ball 16 projects from the surface of the driven rotor 12, the ball 16 becomes engaged with the U-shaped section of the clutch ring 17 and abuts the clutch ring 17. Then, the driven rotor 12 and the clutch ring 17 are linked to each other by the ball 16. Since frictional force acts between the ball 16 and the clutch ring 17 at this time, the clutch ring 17 and the driven rotor 12 tend to rotate together so that the rotary speed of the clutch ring 17 and that of the driven rotor 12 become equal to each other. Since the driven rotor 12 starts rotating from a stopped condition, it gives rise to a rotational difference with the flywheel 9.

Then, as a result, the other side 11B of the coil spring 11 is turned in the sense of winding of the coil spring 11 so that the inner diameter of the coil spring 11 is reduced. As the inner diameter of the coil spring 11 keeps on being reduced, the coil spring 11 clinches the driven rotor 12 and hence becomes linked to the latter. Thus, the driven rotor 12 becomes rotating together with the coil spring 11 and the flywheel 9.

The moment when the driven rotor 12 and the flywheel 9 start rotating together, the rotational energy of the flywheel 9 is transmitted to the driven rotor 12 at a time. Then, the rotary speed of the driven rotor 12 momentarily tends to become greater than that of the flywheel 9 and the sense of rotation of the flywheel 9 tends to become opposite to that of the driven rotor 12. However, the rotary speed of the driven rotor 12 is prevented from exceeding that of the flywheel 9 by the one way clutch 9D so that the driven rotor 12 and the flywheel 9 immediately start rotating together. Then, the coil sprig 11 clinches the driven rotor 12 so that the condition in which the coil spring 11 is linked to the driven rotor 12 is maintained.

At this time, the urging section 15 and the driven rotor 12 are linked to each other by way of the ball 16. Then, as a result, the urging section 15 rotates together with the driven rotor 12. As the driven rotor 12 rotates, the driver segment 18 having the rack 18A that is held in engagement with the pinion 12C of the driven rotor 12 is driven to move toward the front end side of the housing 2. Since the rotation energy of the flywheel 9 is transmitted to the driven rotor 12, the driven rotor 12 abruptly starts rotating at high speed in the condition where the shaft 12 is linked to the coil spring 11. As the driven rotor 12 abruptly starts rotating at high speed, the driver segment 18 is also abruptly driven to move toward the front end side of the housing 2. Note that, as the solenoid 13 becomes ON, the supply of power to the motor 8 is stopped so that the motor 8 rotates freely.

When the driven rotor 14 comes to a rotary position slightly short of the rotary position of about ¾ of a full turn after starting to rotate and hence the front end of the driver segment 18 becomes immediately before colliding with the plate-shaped member 2E of the damper section 2D, the second projecting section 14C of the ratchet mechanism rides on the first projecting section 14G to retract the transmission switch section 14B and the plunger 14 to the OFF position as shown in FIG. 6(*c*). As a result, the urging section 15 moves rightward in FIG. 3 due to the biasing force of the solenoid return spring 14A and the ball 16 abuts the deepest section 15B of the urging section 15. Consequently, the contact between the ball 16 and the clutch ring 17 is cancelled and the clutch comes into an OFF state so that the inner diameter of the coil spring 11 is loosed to become the state before the driving operation. Thus, the linkage of the flywheel 9 and the driven rotor 12 is cancelled. Accordingly, when the driver segment 18 collides with the plate-shaped member 2E of the damper section 2D, the inertial force of the rotating flywheel 9 does not act on the driver segment 18 so that the risk of damaging the damper section 2D is minimized. Then, the nail is driven into the object (workpiece) by the blade 18B arranged at the front end of the driver segment 18.

The energization of the solenoid 13 is terminated and the solenoid 13 comes into an OFF state when the operation of driving the nail is completed and the second projecting section 14C of the ratchet mechanism remains riding on the first projecting section 14G. Then, the plunger 14 is held to the OFF position by the biasing force of the solenoid return spring 14A. Since the urging section 15 is also held at the rightmost position in FIG. 4, the ball 16 remains seated on the surface of the deepest section 15B.

When the linkage between the driven rotor 12 and the coil spring 11 is cancelled after the end of the nail driving operation, no urging force is applied to the driver segment 18 to urge it toward the front end side. Therefore, the driver segment 18 is driven to move toward the rear end side by the driver segment return spring 19 connected to the driver segment 18 and restores the state prior to driving the nail.

While the invention has been described in detail and with reference to the specific embodiment thereof, it would be apparent to those skilled in the art that various changes and modifications may be made therein without departing from the scope of the invention. For example, while the coil spring 11 is made to constantly rotate together with the flywheel 9 in the above-described embodiment, the fastener driver may alternatively be so arranged that the coil spring is made to constantly rotate together with the driven rotor. In the latter case, connection and disconnection between the coil spring and the flywheel can be made by a clutch mechanism.

What is claimed is:

1. An electric fastener driver comprising:

a housing having a fastener driving position;

a motor disposed in the housing;

a magazine attached to the housing for supplying a fastener to the fastener driving position;

a flywheel rotatably supported to the housing and driven by the motor;

a driven rotor rotatably supported to the housing;

a driver segment driven by the driven rotor;

a coil spring capable of transmitting rotation of the flywheel to the driven rotor;

a clutch mechanism selectively coupling the flywheel to the driven rotor through the coil spring, the clutch mechanism comprising a solenoid having a plunger movable between ON position and OFF position; and a ratchet mechanism having a forcible shut off arrangement that forcibly moves the plunger to the OFF position for forcibly shutting off power connection between the flywheel and the driven rotor when the driven rotor is rotated by a predetermined rotation angle after the flywheel and the driven rotor are connected to each other while the solenoid is turned ON.

2. The electric fastener driver as claimed in claim 1, wherein the coil spring is coupled to the driven rotor at the ON position, and the coil spring is separated from the driven rotor at the OFF position.

3. The electric fastener driver as claimed in claim 2, wherein the ratchet mechanism further comprises a transmission switch portion movable together with the plunger in a direction to connect the ON position to the OFF position, and wherein the forcible shut off arrangement comprises:

a first projecting portion provided immovably relative to the housing and projecting in a direction from the ON position to the OFF position, and a second projecting portion provided at the transmission switch portion and projecting from the OFF position to the ON position to be confrontable with the first projecting portion, the second projecting portion being rotatable together with the driven rotor when the clutch mechanism connects the flywheel to the driven rotor.

4. The electric fastener driver as claimed in claim 3, wherein the first projecting portion has a first slanting end and a most protruding first end, and wherein the second projecting portion has a second slanting end contactable with the first slanting end during a first predetermined positional range of the second projecting portion, and has a most protruding second end contactable with the most protruding first end during a second predetermined positional range of the second projecting portion, a distance between the first projecting portion and the second projecting portion in the direction connecting the ON position to the OFF position is changeable depending on the position of the second projecting portion.

5. The electric fastener driver as claimed in claim 4, further comprising a damper disposed in the housing, the driver segment being abuttable against the damper at a terminal phase of a fastener driving operation.

6. The electric fastener driver as claimed in claim 5, wherein the most protruding second end is in contact with the most protruding first end at a timing prior to a timing where the driver segment abuts against the damper.

7. The electric fastener driver as claimed in claim 3, wherein the coil spring has one end portion fixed to the flywheel, and another end portion disposed over the driven rotor having an outer diameter, the another end portion providing an inner diameter greater than the outer diameter of the driven rotor when the plunger is at the OFF position.

8. The electric fastener driver as claimed in claim 7, wherein the driven rotor is of a cylindrical shape providing an internal hollow space, and is formed with a through-hole extending in a radial direction thereof at a position near the another end portion, and wherein the clutch mechanism further comprises:

a contact piece movable in the through-hole in the radial direction;

an urging section disposed in the cylindrical space and movable in the direction connecting the ON position to the OFF position for urging the contact piece in the radial direction dependent on the movement of the urging section; and a clutch ring coaxially disposed around the driven rotor with a slight gap interposed therebetween, the clutch ring having a receiving section that receives the contact piece passing through the through-hole, and a holding section that holds the another end of the coil spring, the driven rotor being drivingly connected to the flywheel when the contact piece is urged to be received in the receiving section by the urging section.

* * * * *